US005730339A

United States Patent [19]

Stolfo

[11] Patent Number: 5,730,339

[45] Date of Patent: Mar. 24, 1998

[54] PAINT CAN HOLDING APPARATUS

[76] Inventor: Eric S. Stolfo, 1645 Mill St., Eugene, Oreg. 97401

[21] Appl. No.: 569,502

[22] Filed: Dec. 8, 1995

[51] Int. Cl.[6] ..... A45F 5/00

[52] U.S. Cl. ..... 224/148.6; 224/148.7; 224/247; 224/250; 224/662; 224/680; 220/737

[58] Field of Search ..... 224/148.4, 148.5, 224/148.6, 148.7, 249, 250, 671, 674, 251, 247, 680, 662; 248/210, 312; 294/31.2, 145, 149, 151; 220/737, 759, 760

[56] References Cited

U.S. PATENT DOCUMENTS

| | | | |
|---|---|---|---|
| 2,985,349 | 5/1961 | McGuire . | |
| 2,995,281 | 8/1961 | Dixon . | |
| 3,319,916 | 5/1967 | Malicoat | 248/210 |
| 3,876,125 | 4/1975 | Emmert | 224/148.7 |
| 4,325,503 | 4/1982 | Swinney . | |
| 4,834,438 | 5/1989 | Haidet | 294/31.2 |
| 4,972,982 | 11/1990 | Harbour . | |
| 5,016,791 | 5/1991 | Burow | 224/148.7 |
| 5,163,591 | 11/1992 | Leiserson et al. . | |
| 5,316,251 | 5/1994 | McGraw | 248/210 |
| 5,445,425 | 8/1995 | Lyver | 220/760 |
| 5,497,921 | 3/1996 | Dancyger et al. | 224/148.6 |

*Primary Examiner*—Linda J. Sholl
*Attorney, Agent, or Firm*—Steven J. Adamson

[57] ABSTRACT

A paint can holding device, including a paint can retaining member having a spacer region between first and second engaging recesses, that is capable of being positioned about a standardized paint can such that the spacer region forms a generally semi-circular configuration about the cylindrical wall of a paint can and the first recess engages a first protrusion of that paint can and the second recess engages a second protrusion of that paint can. A strap is provided that is coupled to the retaining member proximate the first and second recesses and opposite the spacing region. A belt is also disclosed for attachment of the paint can holding device to a user.

17 Claims, 2 Drawing Sheets

PAINT CAN HOLDING APPARATUS

FIELD OF THE INVENTION

The present invention relates to holding a paint can. More specifically, the present invention relates to utilizing inherent aspects of paint can design to securely hold a paint can in a manner that is comfortable to the user, permits the user to paint from a plurality of positions and minimizes spilling.

BACKGROUND OF THE INVENTION

The prior art contains general devices for holding a paint can or other paint holding container. Several of these are directed towards the industry standard one gallon paint can which is well known.

The prior art devices are disadvantageous for one or more of the following reasons, amongst other reasons. One group of prior art paint can holding devices uses straps and buckles to securely hold a can. Insertion and removal of cans in these devices is tedious and time consuming requiring buckling, unbuckling and adjusting strap lengths. They also requiring two hands for removal and insertion which may pose a significant risk to a painter on a ladder.

Another group of prior art paint can holding devices includes those devices that are either disadvantageously bulky, rigid, or large and are therefore cumbersome and potentially dangerous in that they may impede movement of a painter.

Yet another group of prior art paint can holding devices includes those devices which hold a can fixedly such that it does not move towards a levelling position as the physical position of a painter using the device changes. These devices are disadvantageous, amongst other reasons, in that they increase the likelihood of spills.

SUMMARY OF THE INVENTION

Accordingly, it is an object of the present invention to provide an apparatus for holding a paint can that permits ease of insertion or removal of a paint can.

It is another object of the present invention to provide a paint can holding apparatus that is generally streamline and unencumbering.

It is yet another object of the present invention to provide a paint can holding device that generally causes a paint can therein to self-level and self-stabilize.

These and other objects of the present invention are achieved through use of the paint can holding device herein disclosed. In one embodiment, the paint can holding device includes paint can retaining means, having a spacer region between a first and second engaging means, that is capable of being positioned about a standardized paint can such that the said spacer region forms a generally semi-circular configuration about the cylindrical wall of a paint can and the first engaging means engages a first protrusion of the paint can and the second engaging means engages a second protrusion of the paint can. A strap means is provided that is coupled to the retaining means proximate the first and second engaging means opposite the spacer region.

The engaging means may be recessed and concave or V-shaped. A knob for stabilizing and positioning may also be provided adjacent the engaging means.

The strap means or strap is preferably mounted at an angle such that when the strap is supported at the waist of the user and a paint can is placed in the retaining means, the angle and the force of gravity cooperate to cause a can to be held securely in an upright fashion while being freely removable without adjusting said strap. The preferred angle is approximately 60 degrees.

A belt may also be provided for mounting the holding device to a user. Loops or other attachment means are described herein and they are preferably spaced a predefined distance (discussed below) which provides stability against unwanted movement of a paint can in the holding apparatus, while permitting the a paint can to be securely held therein.

The present invention facilitates ease of use. A user simply slides a cylindrical paint can or the like into the holding apparatus. The apparatus holds the can securely by engaging the protrusions of the can. To remove the can one simply lifts the can out of the holding device with one hand, if so desired. When the hanging device is not in use it simply hangs at the side of the painter, or wherever the painter desires. It is light weight and flexible and therefore unobtrusive.

The holding apparatus device may be positioned on the body of the user by rotationally maneuvering the belt around the user so the retaining means is out of the way or in a convenient position for painting.

The apparatus enables a paint can to swing freely during user movement and allows the user to squat during use without spilling the contents of the container, thereby enabling the user to have free range of movement and free function.

The apparatus also permits some control of the amount a paint can movement in Use by adjustment of the length of the strap means. If the user desires greater swing, which may be necessary for a particular use he or she may simply lengthen the strap an inch or so, thereby allowing the can to sweep a greater angle. This adjustability is convenient and comfortable for the user, enables the user to work in many different positions, and allows the device to be accommodating for many different users.

The apparatus is generally simple in design, with an economy of parts, inexpensive materials, and which can be easily and inexpensively manufactured, which makes for an inexpensive retail price.

The attainment of the foregoing and related advantages and features of the invention should be more readily apparent to those skilled in the art, after review of the following more detailed description of the invention taken together with the drawings.

DETAILED DESCRIPTION

Figure 1:
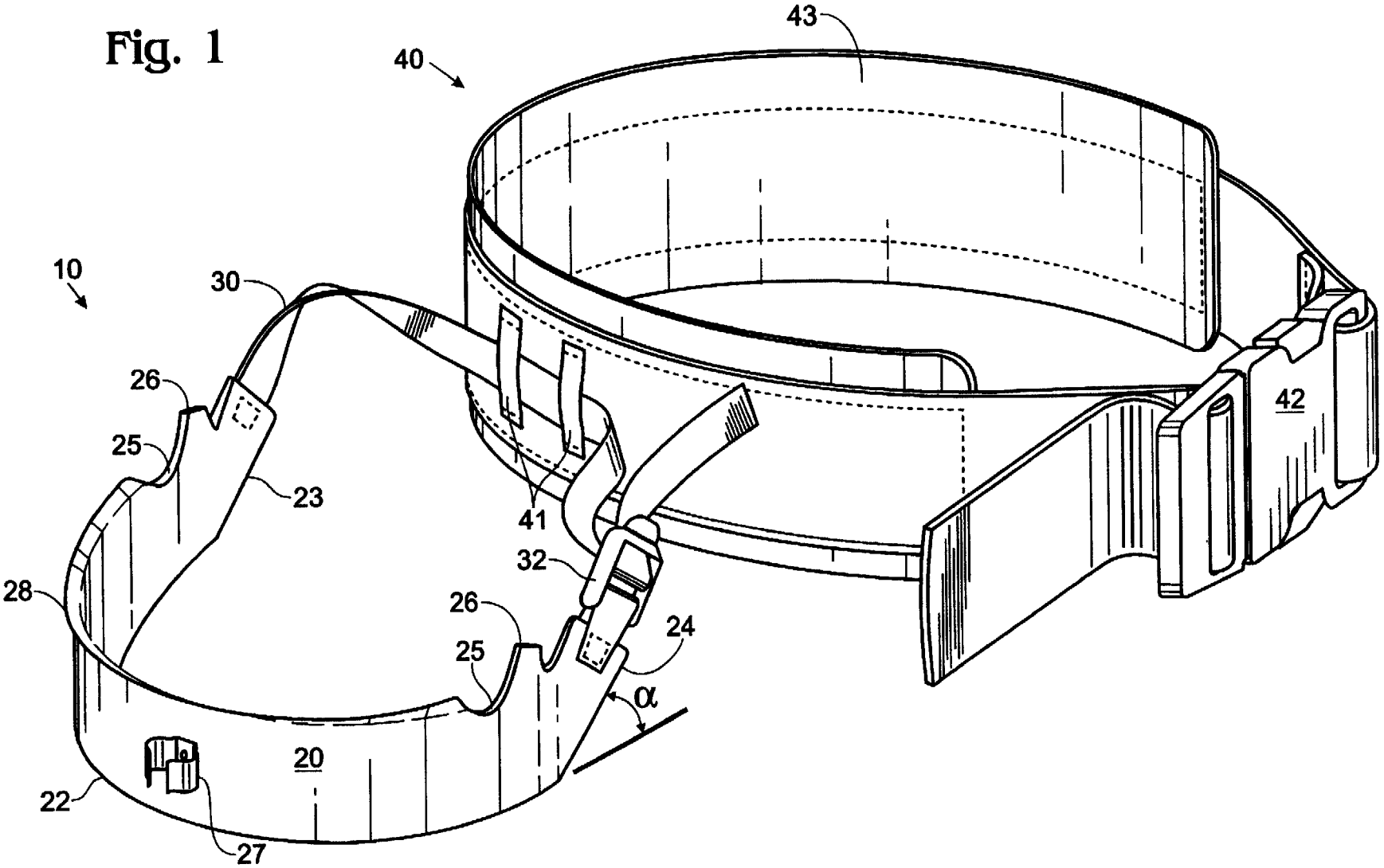
FIG. 1 is a perspective view of a paint can holding device in accordance with the present invention.

Referring to FIG. 1, a perspective view of a paint can holding device 10 and a belt 40 therefor in accordance with the present invention is show. The device 10 includes a retaining member 20 which is held securely about a paint can by attachment strap 30 and gravity as discussed in more detail below. The strap 30 is also used to mount to belt 40.

The can retaining member 20 includes two engaging recesses 25 for receiving the two protrusions of a standard paint can at which the rotatable handle attaches. Knobs 26 are located adjacent the recesses to facilitate in positioning and securing the protrusions therein. Although concave recesses are preferred to match the general circular protrusions, other shaped recesses, such as V-shaped recesses or the like are contemplated.

Figure 2:
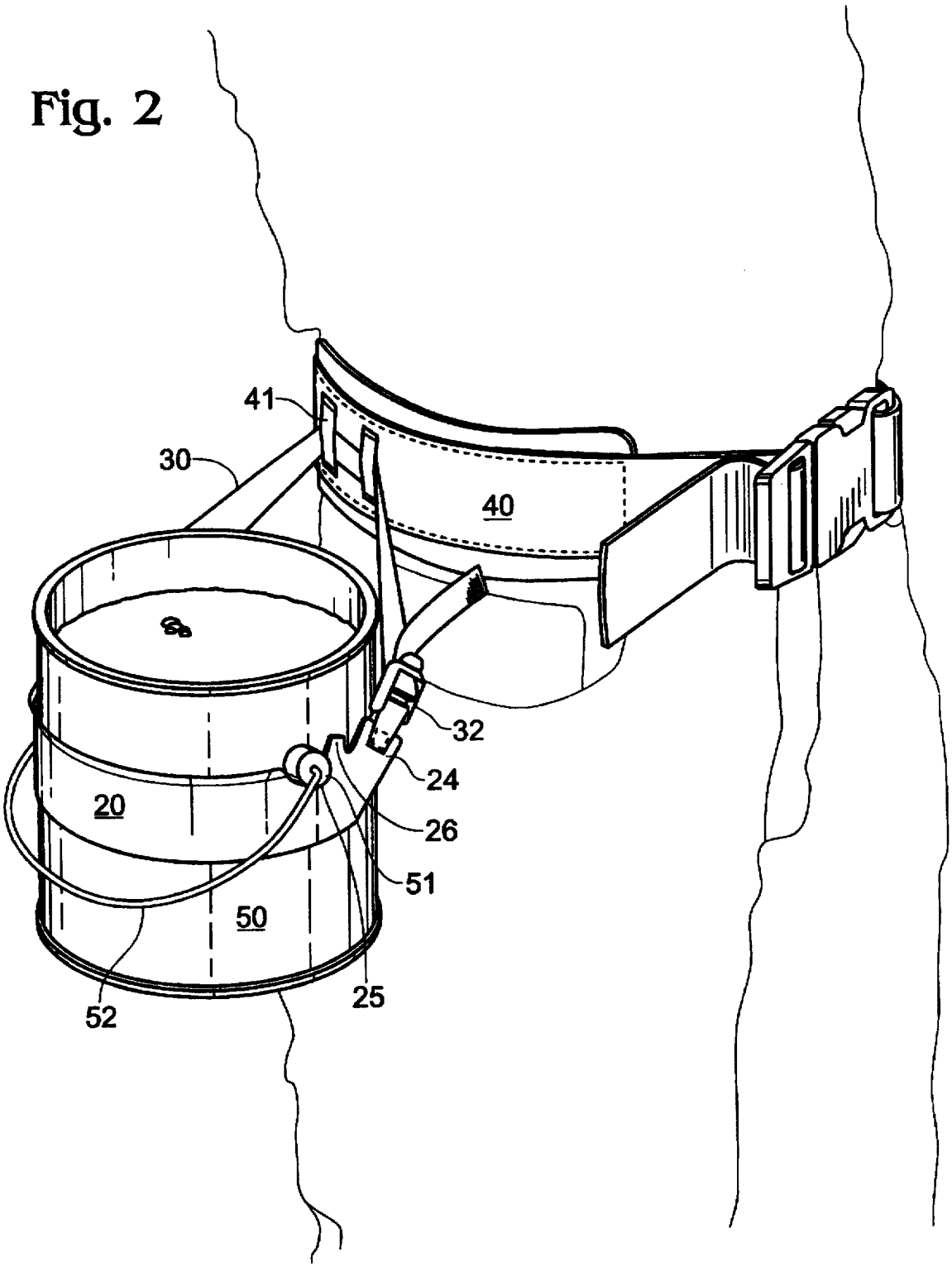
FIG. 2 is a perspective view of a paint can holding device as shown generally in FIG. 1, positioned on a user in accordance with the present invention.

A spacer region 22 that is capable of being formed into a generally semi-circular configuration as shown in FIG. 1 is provided in the retaining member 20 between recesses 25. The spacer region 22, amongst other functions, serves to space recesses 25 an appropriate distance such that when retaining member 20 is wrapped around a paint can (as shown in FIG. 2), the recesses 25 receive the protrusions. An angled flange 28 is preferably provided along a top portion of spacer region 22 to facilitate insertion of a paint can. A clip 27 or loop (not shown) or the like may be mounted on retaining member 20 to hold an implement such as a paint brush, putty knife, paint scraper, screw driver, etc. Clip 27 or a loop or the like may also be mounted on belt 40.

An attachment strap 30 is provided which permits both attachment of the retaining member to a user and which cooperates with the retaining member 20 to securely hold a paint can.

In one embodiment, the strap 30 feeds through two loops 41 in a belt 40 (or through the belt loops of clothing worn by a user or the like). The loops 41 are preferably located a predefined distance from one another that is a compromise between rotational stability and securely holding a paint can. Spacing the loops provides rotational stability. To securely hold a paint can, however, strap 30 must exert a force on a first end 23 and a second end 24 of the retaining member such that, in use, retaining member 20 wraps around a can more than 180 degrees. If the loops 41 are spaced too far apart, the maintenance of recesses 25 securely under the paint can protrusions becomes jeopardized. Attachment of strap 30 on the side of the recesses opposite spacing region 22 further facilitates sufficient wrapping of retaining member 20 about a can.

The strap 30 is preferably attached at an angle, $\alpha$, that cooperates with the force of gravity to securely hold a can but which also permits facile removal of a can. This angle is preferably between 35–80 degrees or more preferably at approximately 60 degrees. The effective length of strap 30 can be adjusted by buckle 32 or other known adjustment mechanisms.

The holding device 10 is preferably affixed to belt 40 as generally described above. The belt 40 may include a buckle 42 or other fastening means and a relatively soft liner 43 to make use of holding device 10 more comfortable.

Referring to FIG. 2, a perspective view of holding device 10 and belt 40 with a paint can 50 mounted in holding device 10 in accordance with the present invention is shown. FIG. 2 illustrates, amongst other features, the seating of paint can protrusions 51 in recesses 25 of the retaining member 20. The manner in which strap 30 preferably holds retaining member 20 in a greater than semi-circular (180 degrees) fashion to securely wrap around a paint can 50 is also shown. Furthermore, the manner in which gravity and the angle of attachment of strap 30 (and sufficient strap length) permit a paint can to be held securely, while also being readily removable is also shown. Empirical evidence has shown that holding device 10 works particularly well when paint can 50 is approximately one-third full. This results in weight generally low in the paint can which facilitates quick levelling and minimization of spills, while providing a normally sufficient and not too heavy quantity of paint.

Having described the general features and operation of device 10 and belt 40 the components thereof and their use are now described in more detail.

The retaining member 20 is preferably made of plastic or similar semi-rigid material, such as polypropylene or the like, and preferably has a semi-circular configuration with a radius of curvature substantially equal to or slightly greater than that of a standard paint can. This configuration permits a paint can to be easily inserted or removed from a loop defined by retaining member 20 and strap 30. Alternatively, the retaining member 20 may be made of neoprene, cloth or nylon webbing, if the preferred characteristics discussed herein are met. A plastic or polymer is preferred because it provides desired rigidity, ruggedness, and ease of shaping (thermo-setting), while being low in cost.

Preferably the retaining member 20 has greater mechanical flexibility at a central portion thereof which allows the retaining member 20 to wrap around a paint can. Greater rigidity is maintained at the engaging recesses 25 and knobs 26, preferably by forming the retaining member 20 of a thicker dimension in this area. The additional thickness and resulting surface area of retaining member 20 at engaging recesses 25 facilitates mounting of the protrusion 51 therein. It should be recognized that while a recessed engaging structure is shown, any number of varying designs could sufficiently secure and support a paint can by its protrusions, yet allow for expeditious and easy mounting/inserting and dismounting/removal of the paint can.

The ends 23, 24 of retaining member 20 where the strap 30 attaches are preferably made relatively thinner than at recesses 25 to facilitate stitching or riveting of the strap. Notwithstanding this consideration, the ends are sufficiently thick for durable use.

As noted above, a top portion of spacer region 22 is preferably angled, and more preferably at approximately 45–60 degrees, away from the center of the loop defined by retaining member 20 and strap 30, and the remainder of spacer region 22 has a straight cross-section. This effectively increases the initial diameter of the annular loop and thereby facilitates insertion of a paint can into holding device 10. Alternatively, the spacer region 22 has a straight cross-section.

Preferably the strap 30 is threaded through two loops 41 spaced 1 to 6 inches apart and more preferably approximately 2.25 inches apart. These loops 41 may be on a pair of pants (not shown) or on belt 40. Spacing less than the amount tends to allow a paint can and retaining member to swing undesirably during user movement, thereby potentially causing spillage of the contents in the can. Providing a mechanism for adjusting the spacing of the loops is contemplated and known methods exist.

As mentioned above, the angle of attachment of strap 30 to retaining member 20 is approximately 60 degrees to horizontal. This causes the bulk of the weight of a paint can to be drawn downward. The horizontal component of this force vector is smaller than the vertical component and the paint can typically rests against the thigh and/or hip of a user 20. Contact and friction of a paint can 30 against a user tends to dampen the amount of movement of the can. This movement may be easily adjusted by the user by either lengthening or shortening the diameter of the loop formed by the retaining member 20 and strap 30. The preferred design enables the user to lengthen the loop by releasing the adjusting means 32, and to shorten the loop by pulling on the loose ended strap 30 which may be achieved with one hand.

The preferred concave shape of engaging recesses 25 enables a paint can to rotate relative to the retaining member 20. This feature and the range of motion provided by strap 30 permits a can 50 to move in such a manner that is generally self-levelling and self-stabilizing.

The belt 40 is preferably made of nylon or a similarly rugged, inexpensive material with an adjustable buckle 42 or functional equivalent. Such belts are well known in the art and are inexpensive.

Among other contemplated embodiments; it should be noted that the retaining member could be substantially greater than a semi-circle, for example, it could be configured such as to form a complete circle. In addition, an insert designed to fit inside a standard paint container in order to accommodate a smaller container yet still utilize holding device 10 is contemplated.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. A paint can holding apparatus, comprising:

paint can retaining means, having first and second ends and having a spacer region between first and second engaging means, that is capable of being positioned about a standardized paint can such that said retaining means forms a generally semi-circular configuration at least slightly greater than 180 degrees about the cylindrical wall of a paint can and said first engaging means engages a first protrusion of that paint can and said second engaging means engages a second protrusion of that paint can;

strap means having a first end coupled to said retaining means proximate said first engaging means on a side of said first engaging means opposite said spacer region and a second end coupled to said retaining means proximate said second engaging means on a side of said second engaging means opposite said spacer region, and wherein said strap means is attached to the retaining means at a point such that a force exerted on the strap means causes the first and second ends of the retaining means to be pulled circumferentially toward each other such that the first and second ends further encircle the paint can.

2. The apparatus of claim 1, wherein said first and second engaging means each include a region that is generally vertically open to facilitate ready insertion and removal of a paint can and has a recessed geometric shape of the class of geometric shapes including U-shape and V-shape to facilitate rotation of a paint can therein about an axis traversing a paint can's protrusions to facilitate self-levelling of that paint can.

3. The apparatus of claim 2, wherein said first and second engaging means each include a knob proximate said recessed region and opposite said spacer region to facilitate positioning of a protrusion of a paint can in the recessed region.

4. The apparatus of claim 3, wherein each of said knobs extends above a generally horizontal level of said spacer region.

5. The apparatus of claim 1, wherein said strap means is attached to said retaining means at an angle of approximately 35–80 degrees.

6. The apparatus of claim 5, wherein said angle is approximately 60 degrees.

7. The apparatus of claim 5, wherein the length of said strap means is adjustable.

8. The apparatus of claim 1, wherein said strap means is flexible.

9. The apparatus of claim 1, further comprising means coupled to said retaining means for attaching an accessory item.

10. A paint can holding apparatus, comprising:

paint can retaining means, having first and second ends and having a spacer region between first and second engaging means, that is capable of being positioned about a standardized paint can such that said retaining means forms a generally semi-circular configuration at least slightly greater than 180 degrees about the cylindrical wall of a paint can and said first engaging means engages a first protrusion of that paint can and said second engaging means engages a second protrusion of that paint can;

strap means having a first end coupled to said retaining means proximate said first engaging means on a side of said first engaging means opposite said spacer region and a second end coupled to said retaining means proximate said second engaging means on a side of said second engaging means opposite said spacer region;

wherein said strap means is attached to the retaining means at a point such that a force exerted on the strap means causes the first and second ends of the retaining means to be pulled circumferentially toward each other such that the first and second ends further encircle the paint can; and belt means having means for attaching to said strap means in such a manner that said strap means pulls said retaining means more than 180 degrees around a standardized paint can for which said retaining means is designed when said strap means are taunt.

11. The apparatus of claim 10, wherein said strap means further comprise a first portion including said first end and a second portion including said second end; and wherein a distance between where said first portion and said second portion attach to said belt means by said attaching means is a compromise between the distance that affords the best rotational stability of a paint can held by said retaining means and the distance that affords the most secure circumferential retention of a paint can in said retaining means.

12. The apparatus of claim 11, wherein said distance is approximately 2.25 inches.

13. The apparatus of claim 11, wherein said distance is between 1" and 6".

14. The apparatus of claim 10, wherein said first and second engaging means each include a region that is recessed below a level of at least a portion of said spacer region adjacent said engaging means.

15. The apparatus of claim 14, wherein said first and second engaging means each include a knob proximate said recessed region and opposite said spacer region to facilitate positioning and secure retention of a protrusion of a paint can in the recessed region.

16. The apparatus of claim 10, wherein said strap means is flexible.

17. An apparatus for holding a paint can, comprising:

paint can retaining means, having a spacer region between first and second engaging means, that is capable of being positioned about a standardized paint can such that said retaining means forms a generally semi-circular configuration at least slightly greater than 180 degrees about the cylindrical wall of a paint can and said first engaging means engages a first protrusion of that paint can and said second engaging means engages a second protrusion of that paint can;

strap means having a first end coupled to said retaining means proximate said first engaging means on a side of said first engaging means opposite said spacer region and a second end coupled to said retaining means proximate said second engaging means on a side of said second engaging means opposite said spacer region;

belt means having means for attaching to said flexible strap means in such a manner that said flexible strap means pull said retaining means more than 180 degrees around a standardized paint can for which said retaining means is designed when said flexible strap means are taunt;

wherein said strap means further comprise a first portion including said first end and a second portion including said second end, and a distance between where said first portion and said second portion attach to said belt means by said attaching means is a compromise between the distance that affords the best rotational stability of a paint can held by said retaining means and the distance that affords the most secure retention of a paint can in said retaining means; and wherein said attaching means include loops that are spaced said distance.

* * * * *